US006263632B1

(12) United States Patent
Cadorette

(10) Patent No.: US 6,263,632 B1
(45) Date of Patent: Jul. 24, 2001

(54) ADJUSTABLE DECORATIVE SHUTTER

(75) Inventor: Mario Cadorette, Sainte Thérès (CA)

(73) Assignee: Royal Window Coverings (Canada) Inc., Quebec (CA)

( * ) Notice: Subject to any disclaimer, the term of this patent is extended or adjusted under 35 U.S.C. 154(b) by 0 days.

(21) Appl. No.: 09/337,263

(22) Filed: Jun. 22, 1999

(30) Foreign Application Priority Data

Apr. 20, 1999 (CA) ..... 2269433

(51) Int. Cl.[7] ..... E06B 7/08

(52) U.S. Cl. ..... 52/473; 52/314; 52/455; 52/586.2; 52/800.12; 49/75; 454/221; 403/331

(58) Field of Search ..... 52/473, 455, 314, 52/311.1, 566.2, 800.12; 160/166.1, 172, 223; 49/75, 74; 454/221; 403/331, 363, 381

(56) References Cited

U.S. PATENT DOCUMENTS

| | | | | |
|---|---|---|---|---|
| 3,191,242 | | 6/1965 | Rauen . | |
| 3,455,079 | | 7/1969 | Frederick . | |
| 3,797,186 | | 3/1974 | Smith . | |
| 3,932,959 | | 1/1976 | Jansons et al. . | |
| 3,968,738 | | 7/1976 | Matzke . | |
| 4,192,369 | | 3/1980 | Taylor . | |
| 4,251,966 | | 2/1981 | Foltman . | |
| 4,444,243 | | 4/1984 | Voney et al. . | |
| 4,765,110 | | 8/1988 | MacLeod . | |
| 4,939,880 | * | 7/1990 | Wang | 52/473 |
| 4,967,511 | * | 11/1990 | Werginz et al. | 49/371 |
| 5,060,442 | * | 10/1991 | Chubb | 52/473 |
| 5,152,116 | * | 10/1992 | MacGowan | 52/473 |
| 5,307,858 | | 5/1994 | Turner . | |
| 5,617,688 | * | 4/1997 | Gandy et al. | 52/473 |
| 5,826,393 | * | 10/1998 | Wenzlaff et al. | 52/473 |
| 5,924,255 | * | 7/1999 | Vagedes | 52/473 |
| 5,996,298 | * | 12/1999 | Wenzlaff et al. | 52/473 |

* cited by examiner

*Primary Examiner*—Carl D. Friedman
*Assistant Examiner*—Yvonne M. Horton
(74) *Attorney, Agent, or Firm*—Sughrue, Mion, Zinn, Macpeak & Seas, PLLC

(57) ABSTRACT

An adjustable shutter includes a substantially rectangular shutter frame having first and second pairs of opposed spaced apart frame members 3*a*, 3*b* defining a substantially rectangular opening between the frame members. A plurality of substantially parallel louvers 5 are operatively mounted within the shutter opening and extend between the opposed pair of first frame members. The louvers are capable of at least partially occluding the rectangular opening of the shutter frame. A respective frame cover 6*a*, 6*b* is operatively affixed to each one of the frame members. An adjustment mechanism is disposed between at least one frame member and its respective frame cover, and is operable to adjust a separation between the frame member and its respective same cover, such that a first overall dimension of the shutter can be adjusted. Finally, a respective corner cover member 7 is disposed in operative relation to each of the frame covers to visually occlude a gap between each adjacent frame cover.

15 Claims, 8 Drawing Sheets

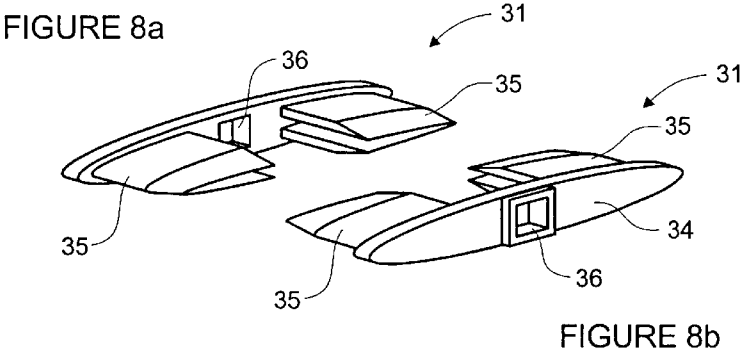
FIGURE 8a
FIGURE 8b
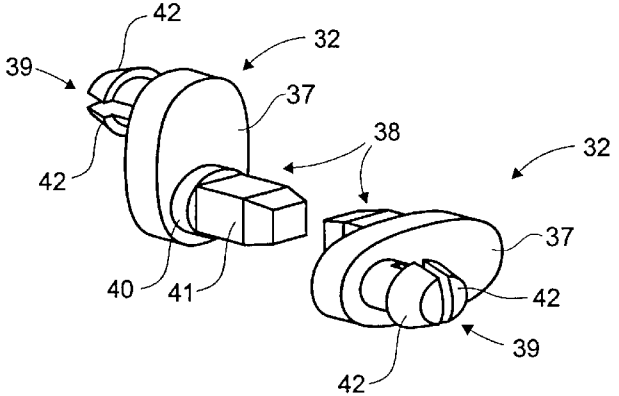
FIGURE 9a
FIGURE 9b
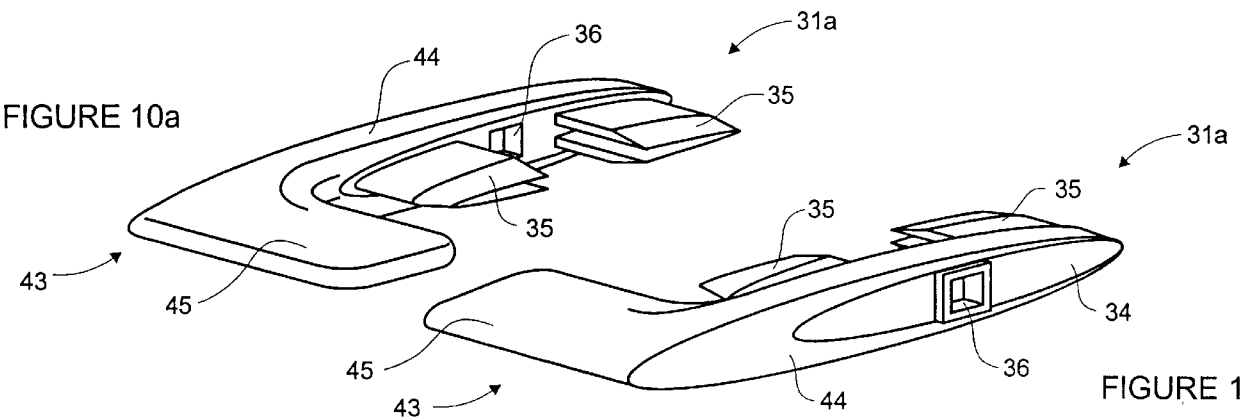
FIGURE 10a
FIGURE 10b

ADJUSTABLE DECORATIVE SHUTTER

CROSS REFERENCE TO RELATED APPLICATIONS

This application is related to, and claims priority of, Canadian Patent Application No. 2,269,433 filed Apr. 20, 1999.

MICRO-FICHE APPENDIX

Not applicable.

FIELD OF THE INVENTION

The present invention relates to an adjustable decorative shutter, and more particularly to a decorative shutter which is adjustable in both height and width.

BACKGROUND OF THE INVENTION

Adjustable louver and panel shutters, including specifically shutters of modulus rigid molded plastic construction, have heretofore been proposed in the art.

U.S. Pat. No. 4,251,966 (Foltman) teaches an adjustable-length shutter which comprises a pair of extruded side rails having respective single-channel tracks disposed in opposition. Louvered panels are injection molded with integral side runners which are slidably received in the opposing tracks. Upper and lower cross pieces are fastened to the side rails by fasteners to hold the panels in place. Adjustment of the height dimension of the shutter is accomplished by cutting the side rails to the desired length, and then cutting the louvered panel(s) as required to fit within the available opening. This necessarily requires careful measuring and cutting, on the job site, in order to achieve an esthetically pleasing result. Furthermore, for practical purposes, the height adjustment is restricted to increments equal to the spacing of the louvers in the louvered panel, as cutting the panel at an intermediate position within a louver slat produces an unsightly result. Finally, Foltman '966 does not provide any means of adjusting the width of the shutter.

U.S. Pat. No. 4,765,110 (MacLeod) adjustable-length shutter which comprises a pair of extruded side rails having respective single-channel tracks disposed in opposition. Louvered panels are injection molded with integral side runners which are slidably received in the opposing tracks. Upper and lower cross pieces are fastened to the side rails by fasteners to hold the panels in place. Adjustment of the height dimension of the shutter is accomplished by cutting the side rails to the desired length, and then assembling the shutter so that a portion of one louvered panel is received within (and concealed by) the upper cross piece. While the shutter of MacLeod '110 permits a finer adjustment of the length of the shutter, the fact that the upper portion of the louvered panel is received within the top cross piece means that the severely limits the extent to which the height can be adjusted without producing an unsightly result.

U.S. Pat. No. 3,932,599 (Jansons et al.) teaches a height-adjustable shutter comprising a pair of opposed vertical frame members secured by top and bottom members to define a rectangular frame. A plurality of slats or louvers are pivotally mounted within the frame. Height adjustment is accomplished by means of legs which extend downwardly from the vertical frame members, and parallel horizontal slots provided on the bottom member. The legs are designed to be cut on site to a desired length, and a boot having a generally hollow U-shaped cross-section is fitted on the bottom of the shutter between the severed legs and in engagement with one of the horizontal slots of the bottom member.

U.S. Pat. Nos. 3,191,242, (Rauen), 3,797,186 (Smith), and 3,968,738 (Matzke) also teach adjustable shutters.

One problem with adjustable length shutter assemblies of the prior art is a requirement that components of the shutter must be cut or trimmed on site. In some cases, fairly complex cutting or trimming operations are required for tailoring overall length at the installation site. The side rails in Foltman '966, for example, are cut to length in a stepped, rather than a planar, configuration. In Frederick '079, the integral panel and side rail must be trimmed to length and then slotted to receive the end rails. Cutting and trimming of shutter components requires the use of proper tools and a high degree of skill in order to achieve a fine finish of the cut components and thus an esthetically pleasing finished shutter.

Another problem with adjustable shutter assemblies of the prior art is that they typically permit adjustment of only one overall dimension, usually length. However, in order to achieve a "custom-fitted" appearance, it will frequently be desirable to adjust both the length and width of the shutter assembly.

SUMMARY OF THE INVENTION

An object of the present invention is to provide a shutter which can be readilly adjusted in longitudinal and/or laterial dimensions (i.e. width and/or height) independently.

Another object of the present invention is to provide a shutter assembly in which adjustments in the overall dimensions of the shutter can be accomplished without cutting or trimming anycomponents.

Another object of the present invention is to provide a shutter assembly in which adjustments in the overall dimensions of the shutter can be accomplished easily, and without the use of special tools.

Accordingly, an aspect of the present invention provides an adjustable shutter comprising; a substantially rectangular shutter frame comprising two pairs of opposed spaced apart frame members and defining a substantially rectangular opening between the frame members; a plurality of substantially parallel louvers operatively mounted within the shutter opening and extending between the opposed pair of first frame members, the louvers being capable of at least partially occluding the rectangular opening of the shutter frame; a respective frame cover operatively affixed to each one of the frame members; an adjustment mechanism disposed between at least one frame member and its respective frame cover, the adjustment means being operable to adjust a separation between the frame member and its respective frame cover, whereby a first overall dimension of the shutter can be adjusted; and a respective corner cover member disposed in operative relation to each of the frame covers to visually occlude a gap between each adjacent frame cover.

In an embodiment of the invention, the adjustment mechanism comprises: a pair of opposed walls of a frame member defining an interior longitudinal channel, each the opposed walls comprising a plurality of parallel opposed longitudinal grooves; and a cantilevered wall disposed longitudinally within a respective frame cover, the cantilevered wall being suitably dimensioned to facilitate sliding engagement within the longitudinal channel of the frame member, a free longitudinal edge of the cantilevered wall comprising at least one pair of opposed longitudinal ridges capable of sliding engagement with a respective pair of opposed longitudinal grooves.

In an embodiment of the invention, the two pairs of opposed frame members comprise one pair of opposed elongate first frame members adapted for operatively supporting the purality of louvers, and one pair of opposed elongate second frame members capable of being substantially ridgidly affixed to the first frame members for maintaining the first frame members in substantially parallel spaced relation.

In an embodiment of the invention, an adjustment mechanism is provided between at least one first frame member and its respective frame cover, whereby an overall lateral dimension of the shutter can be adjusted. Preferably, an adjustment mechanism is provided between at each first frame member and its respective frame cover, to thereby permit a maximum extent of adjustment of the overall lateral dimension of the shutter.

In an embodiment of the invention, wherein an adjustment mechanism is provided between at least one second frame member and its respective frame cover, whereby an overall longitudinal dimension of the shutter can be adjusted. Preferably, an adjustment mechanism is provided between at each first frame member and its respective frame cover, to thereby permit a maximum extent of adjustment of the overall longitudinal dimension of the shutter.

In a preferred embodiment of the invention, a respective first adjustment mechanism is provided between at least one first frame member and its respective frame cover, and a respective second adjustment mechanism is provided between at least one second frame member and its respective frame cover, whereby overall lateral and longitudinal dimensions of the shutter can be adjusted independently of one another.

In an embodiment of the invention, the plurality of louvers are operatively affixed to a pair of opposed louver rails to define a louver frame, the louver frame being secured within the shutter frame by securing each of the louver rails to a respective one of the first frame members. Preferably, each louver rail includes a pair of opposed longitudinal edge portions slidably engagable with a corresponding pair of opposed longitudinal groove portions of a respective first frame member, whereby the louver rail can be secured to the respective first frame member by sliding the louver rail longitudinally of the first frame member to engage the longitudinal edge portions of the louver rail with the longitudinal groove portions of the first frame member.

In an embodiment of the invention, the louvers are ridgidly mounted on the louver rails. In a preferred embodiment of the invention, the louvers are pivotably mounted on the louver rails.

In an embodiment of the invention, each one of the plurality of louvers is secured to the louver rails by means of a respective pair of louver end assemblies, each louver end assembly comprising: a louver end cap substantially rigidly affixed an end of the louver, and including a shaft portion capable of rotatably engaging a support hole of a respective louver rail; and a cam rigidly mountable on a free end of the shaft portion, the cam being capable of securing the louver end cap within the support hole of the respective louver rail so as to prevent the louver from disengaging from the louver rail.

A preferrred embodiment of the invention further comprises a cam connector capable of operatively engaging a free end of the cam of each louver end assembly pivotably mounted on a respective louver rail, whereby all of the plurality of louvers will pivot in unison. Still more prefereably, the louver end assemblies mounted on one of the louver rails are assembled so that the cams thereof are oriented at a first predetermined angle with respect to the louvers, and the louver end assemblies mounted on the other one of the louver rails are assembled so that the cams thereof are oriented at a second predetermined angle with respect to the louvers, the first and second predetermined angles being separated by approximately 90 degrees. This later arrangement allows the louvers to rotate in unison through an angle greater than 90 degrees without binding or jaming of the cams and cam connectors.

BRIEF DESCRIPTION OF THE DRAWINGS

Further aspects, features and advantages of the present invention will be apparent from the following detailed description of the preferred embodiments, taken in conjunction with the appended drawings, in which:

FIGS. 8*a* and 8*b* show respective perspective views of a louver end cap of FIG. 7;

FIGS. 9*a* and 9*b* show respective perspective views of a cam unit of FIG. 7; and FIGS. 10*a* and 10*b* show respective perspective views of a louver end cap and handle of FIG. 7.

DETAILED DESCRIPTION OF THE PREFERRED EMBODIMENTS

Figure 1:
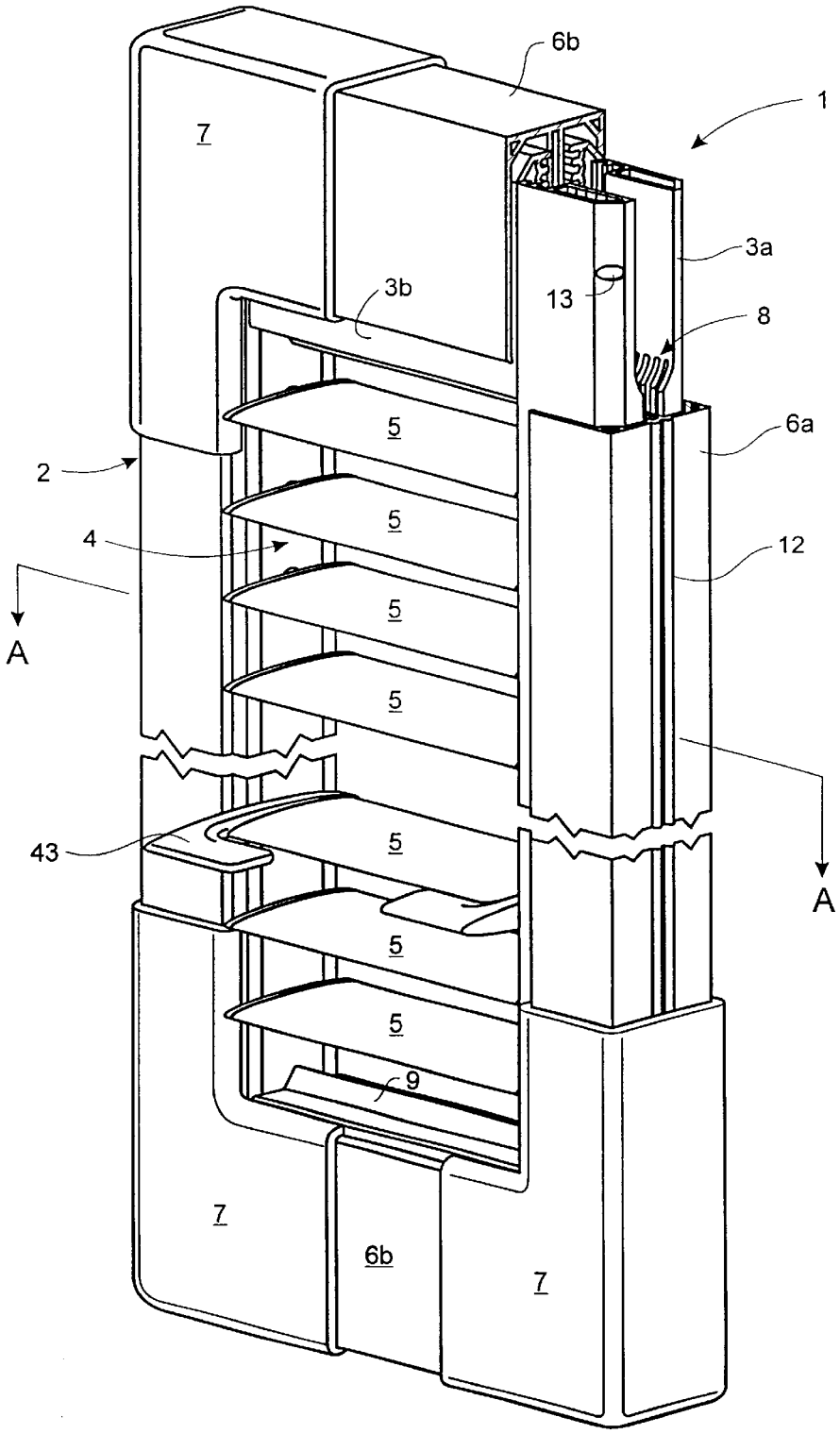
FIG. 1 is a perspective view showing an adjustable shutter in accordance with an embodiment of the present invention.

Referring to FIG. 1, an adjustable shutter 1 in accordance with the present invention includes a substantially rectangular shutter frame 2 comprising two pairs of opposed frame members 3*a*, 3*b* and having a substantially rectangular shutter opening 4; a plurality of substantially parallel louvers 5 operatively mounted within the shutter opening 4; a respective frame cover 6*a*, 6*b* operatively affixed to each one of the frame members 3*a*, 3*b*; and a corner cover member 7 disposed in operative relation to each of the frame covers to visually occlude a gap between each adjacent frame cover 6. Note that in FIG. 1 the shutter 1 is illustrated with one corner cover member 7 removed for purposes of illustration only. An adjustment mechanism 8 is disposed between at least one frame member 3*a* and its respective frame cover 6*a* so that a corresponding overall dimension of the shutter 1 can be adjusted.

Figure 6C:
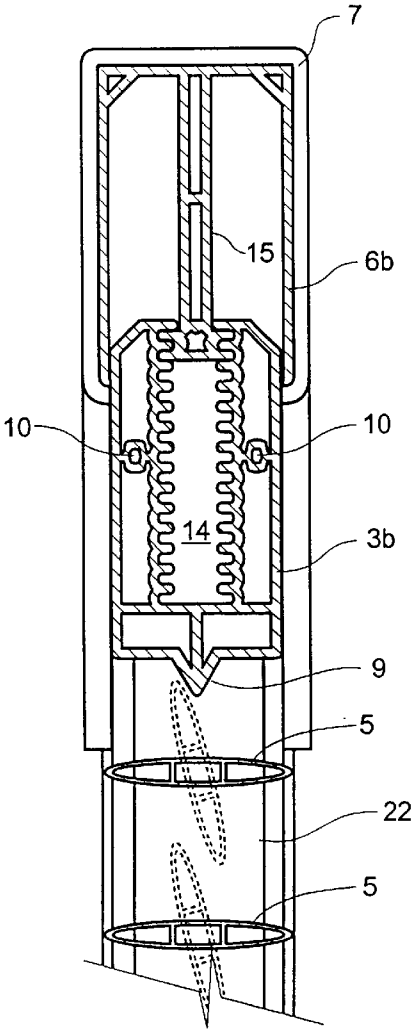
FIGS. 6*a*, 6*b*, and 6*c* are cross-sectional views showing an end frame member and end frame cover at respective lower limit, intermediate stage, and upper limit of the range of adjustment of the adjustment mechanism.
Figure 6B:
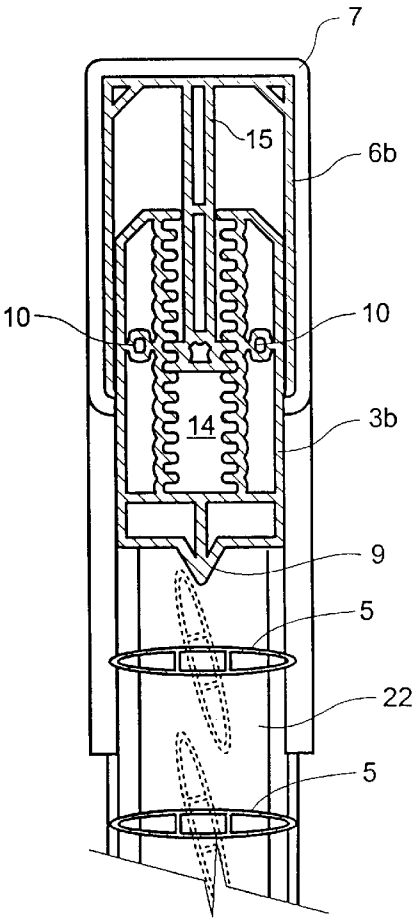
Figure 6A:
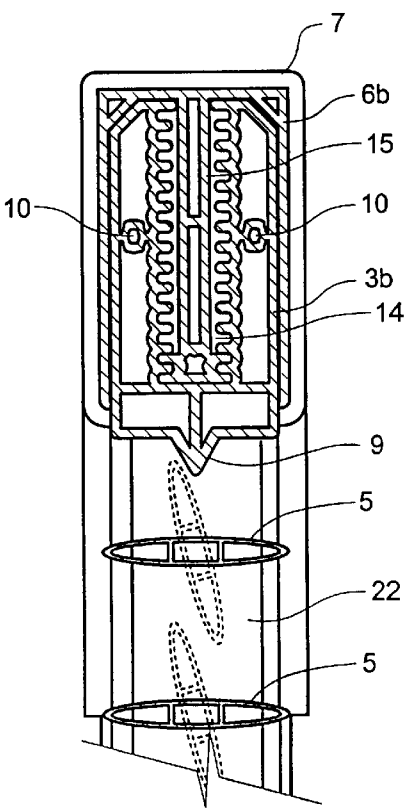

The frame members, can be provided with a common cross-sectional shape. In this case, the respective frame covers will also have a common cross-section, and may be formed simply by cutting a piece of extruded stock into suitable lengths. Preferably, however, the frame members will be divided into a pair of opposed side frame members 3*a* and a pair of end frame members 3*b* (see FIG. 2) as in the illustrated embodiment. In this latter case, the side frame members 3*a* can be made to be narrower in width than the end frame members 3*b*, which serves to enhance the visual appearance of the assembled shutter 1. Additionally, the end frame members 3*b* can suitably be provided with an inward extension 9 which serves to reduce the passage of light between the end frame member 3*b* and an adjacent louver 5, when the louvers 5 are pivoted to the closed position (See FIGS. 6*a–c*). The end frame members 6*a* can also conveniently be provided with resilient fastener receptacles 10 for receiving a respective screw 11 (or other suitable mechanical fastener) used to assemble the side frame members 3*a* to the end frame members 3*b* (See FIGS. 6*a–c*).

Figure 2:
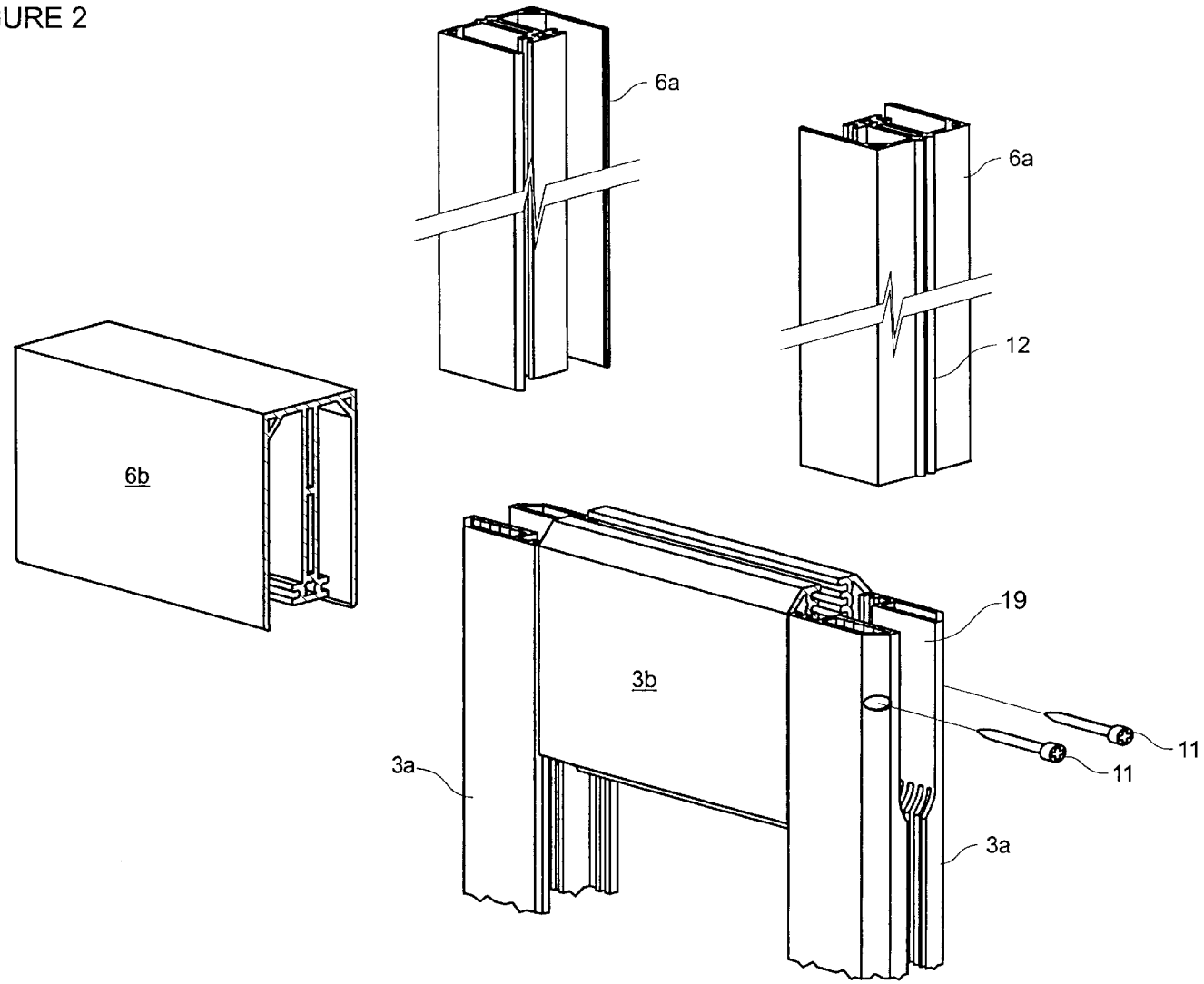
FIG. 2 is a partially exploded view of the embodiment of FIG. 1, showing the principal elements of the shutter frame.

As may be seen in FIG. 2, the frame covers are similarly divided into side frame covers 6*a* and end frame covers 6*b*, which are suitably dimensioned to interfit with the respective side and end frame members 3*a*, 3*b*. The side and end frame covers 6*a* and 6*b* will preferably have generally similar cross-sectional shapes (except, of course, in the width dimension) to provide continuity in visual appearance of the assembled shutter. However, the side frame covers 6*a* will preferably have at least one ridge 12 (two are shown in the illustrated embodiment) along the length of an exterior surface thereof. This ridge 12 serves to reduce the passage of light between the sides of the assembled shutter and a window frame (or an adjacent shutter), when the shutter is closed.

The frame members can be manufactured from any convenient material, such as, for example, metals (e.g. alluminum or steel), or plastics, having suitable properties of strength, resilience, and rigidity. In a particularly preferable embodiment, the frame members are composed of polyvinylchloride (PVC) material. Similarly, the frame covers and corner cover members 7 can be manufactured from any suitable material, such as, for example, metals or plastics, and will preferably be composed of the same material as the frame memebers.

Various known methods can suitably be employed to manufature the components of the shutter frame. For example, the frame members and frame covers can conveniently be formed by extrusion, thereby providing a constant cross section allong the length of these components, a high quality surface finish, and low manufacturing cost. The corner members can conveniently be manufactured by injection moulding.

The shutter frame 2 can conveniently be assembled by cutting the end frame members 3*a* to a suitable length and then securing the side frame members 3*b* to the opposite ends of the end frame members by means of adhesives and/or screws 11 (or any other suitable mechanical fastener), as shown in FIG. 2. In order to facilitate assembly of the shutter frame 2, a pair of access holes 13 (one is visible in FIG. 1) can be provided near each end of each side frame member 3*b* to permit passage of a respective screw 11.

Referring now to FIGS. 4*a*–6*c*, the adjustment mechanism 8 is provided as a two-part assembly of a groove channel 14, and an interfitting cantilever wall 15. In the illustrated embodiment, a groove channel 14 is provided within each side and end frame member 3*a*, 3*b* and the corresponding cantilevered wall 15 is provided in each side and end frame cover 6*a*, 6*b*. It will be apparent, however, that these positions could be reversed. That is, groove channels 14 could be provided within each frame cover, and the corresponding cantilever wall 15 provided in the frame members.

The groove channel 14 runs longitudinally along the entire length of each side and end frame member 3*a*, 3*b* and is generally provided as a pair of opposed parallel walls 16, defining the channel 14 therebetween. The facing interior surfaces of the two walls 16, are contoured to define a plurality of substantially parallel grooves 18 having a predetermined pitch p, which determines the minimum increments by which the dimensions of the shutter 1 can be adjusted. The size of the pitch p will normally be determined by considerations of inter alia cost of manufacture, material strength and stiffness, and ease of assembly of the shutter components. Conveniently, a pitch p of ⅛ inch can be provided. The depth of the groove channel 14 will conveniently be approximately equal to an integer multiple of the pitch p, or larger, to accommodate as many grooves as possible, and will be generally limited by the desired dimentions of the frame member 3*a*, 3*b* and the desired range of adjustment. Thus in the illustrated emblodiment, the groove channel 14 of the side frame members 3*a* has six grooves and a depth of approximately ¾ inch. On the other hand, the groove channel 14 of the end frame members 3*b* has 14 grooves and a depth of approximately 1¾ inch.

As may be seen in FIGS. 1 and 2, it is advantageous to cut away the grooves 18 of the groove channel 14 proximal each end of the side frame members 3*a* in order to define a clearance passage 19 which serves to permit passage of the cantilever wall 15 of the adjacent end frame cover 6*b*. This arrangement allows the end frame cover 6*b* to be removed and installed as desired to adjust the overall length of the shutter 1, without disassembly of the shutter frame 2.

The cantilever wall 15 runs longitudinally along the entire length of the frame covers and has a total height roughly corresponding to the total depth of the corresponding groove channel 14. The thickness of the cantilever wall 15 is selected to be slightly less that the interior width of the groove channel 14, so that the cantilever wall 15 can slide within the groove channel 14 without binding. The free longitudinal edge of the cantilever wall 15 is provided with at least one pair of opposed ribs 20 designed to engage corresponding grooves 18 of the groove channel 14. The cantilever wall 15 can be provided with as few as one pair of opposed ribs 20, or may have two pairs (or more) of opposed ribs 20, as shown in the illustrated embodiment. Where two (or more) pairs of ribs 20 are employed, adjacent pairs of ribs 20 are separated by the pitch p of the grooves 18, so that the ribs 20 will engage any of the grooves 18 of the corresponding groove channel 14 without binding or jamming.

It will be seen that the maximum range of adjustment, and the minimum adjustment increment will be determined by the number of grooves of the groove channel, the number of corresponding pairs of ribs of the cantilever wall, and the groove pitch p. In general, the range of adjustment will be given by the equation:

$$R=p(g-n+1)$$

Where

R=the range of adjustment g=the number of groove pairs in the groove channel n=the number of pairs of ribs of the cantilever wall; and p=the groove pitch In the illustrated embodiment, the groove channels 14 of the side frame members 3*a* have six sets of grooves with a pitch p of ⅛ inch. The cantilevered wall 15 of the side frame covers 6*a* have two pairs of ribs 20. Thus the width of each side of the shutter frame 2 can be adjusted through a range of ⅛*(6−2+1)=⅝ inch in ⅛ inch increments. Both sides of the shutter frame 2 can be adjusted independently through this range, so that the maximum adjustment of the overall width of the shutter 1 will be double this amount (i.e. 1¼ inch).

Similarly, in the illustrated embodiment, the groove channels 14 of the end frame members 3*b* have 14 sets of grooves with a pitch p of ⅛ inch. The cantilevered wall 15 of the end frame covers 6*b* have two pairs of ribs 20. Thus the height of each end of the the shutter frame 2 can be adjusted through a range of 1⅝ inch in ⅛ inch increments. Both ends of the shutter frame 2 can be adjusted independently through this range, so that the maximum adjustment of the overall height of the shutter 1 will be double this amount (i.e. 3¼ inch).

Figure 7:
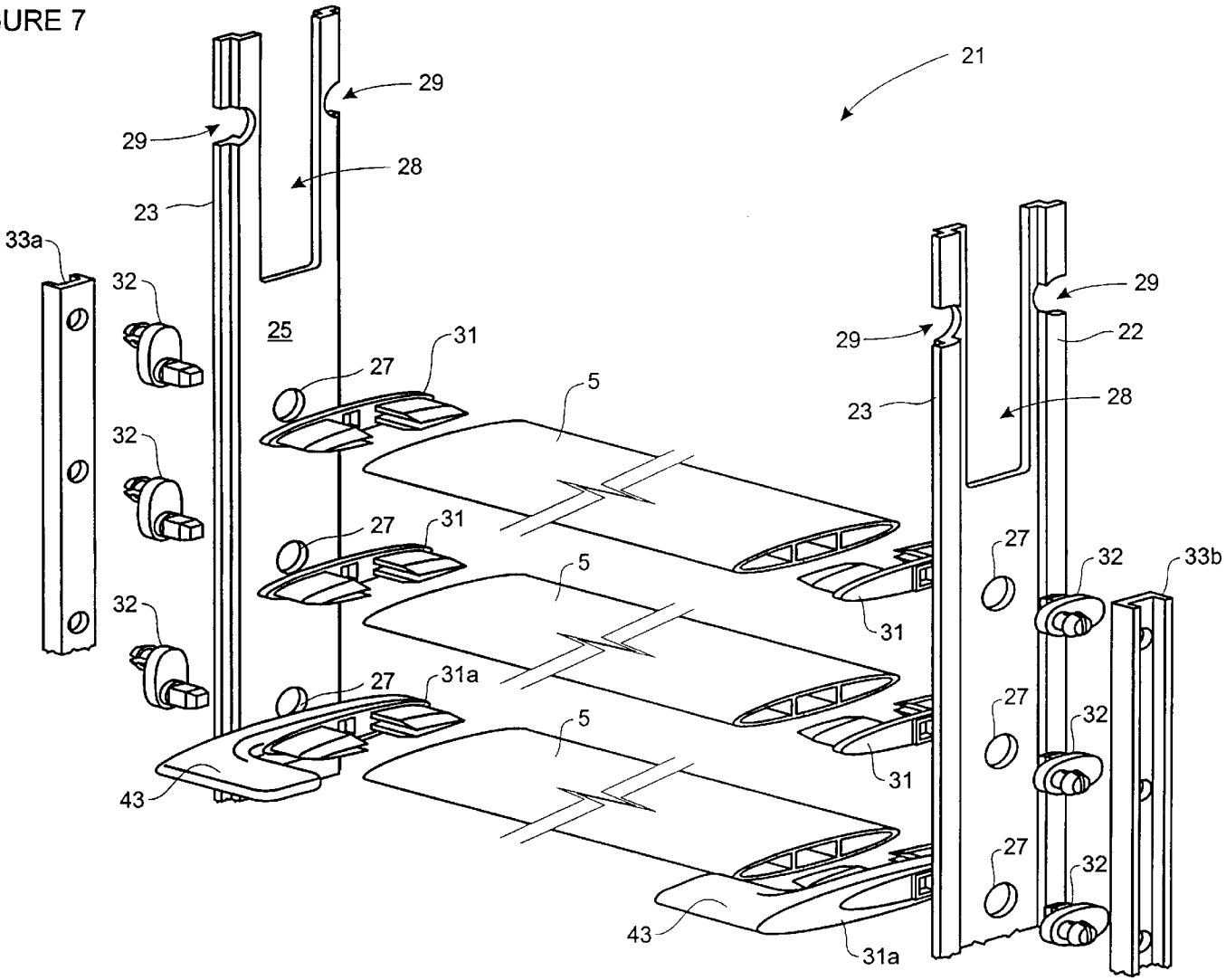
FIG. 7 is an exploded view of the louver frame of the embodiment of FIG. 1.

FIG. 7 is an exploded view of a louver frame 21 usable in the embodiment of the invention illustrated in FIG. 1. For simplicity and clarity of illustration, one end of the louver frame 21 is shown, it being understood that the other end of the louver frame 21 will be closely similar, and that the louver frame 21 can be made to any desired length. The louver frame 21 generally comprises a pair of opposed louver rails 22 between which the plurality of louvers 5 are operatively mounted. The louver frame 21 is secured within the shutter frame 2 by securing each of the louver rails 22 to a respective one of the side frame members 3*a*. In the illustrated embodiment, each louver rail 22 includes a pair of opposed longitudinal edge portions 23 slidably engagable with a corresponding pair of opposed longitudinal rail grooves 24 of a respective side frame member 3*a*. Using this arrangment, each louver rail 22 can be secured to its respective side frame member 3*a* by sliding the louver rail 22 longitudinally of the side frame member 3*a* to engage the longitudinal edge portions 23 of the louver rail 22 with the longitudinal rail grooves 24 of the side frame member 3*a*.

The louvers 5 can be ridgidly mounted on the louver rails 22, in which case, the louvers 5 and louver rails 22 could conveniently be manufactured as a single unit, for example by injection moulding. However, in the illustrated embodiment of the invention, the louvers 5 are pivotably mounted on the louver rails 22.

Figure 3:
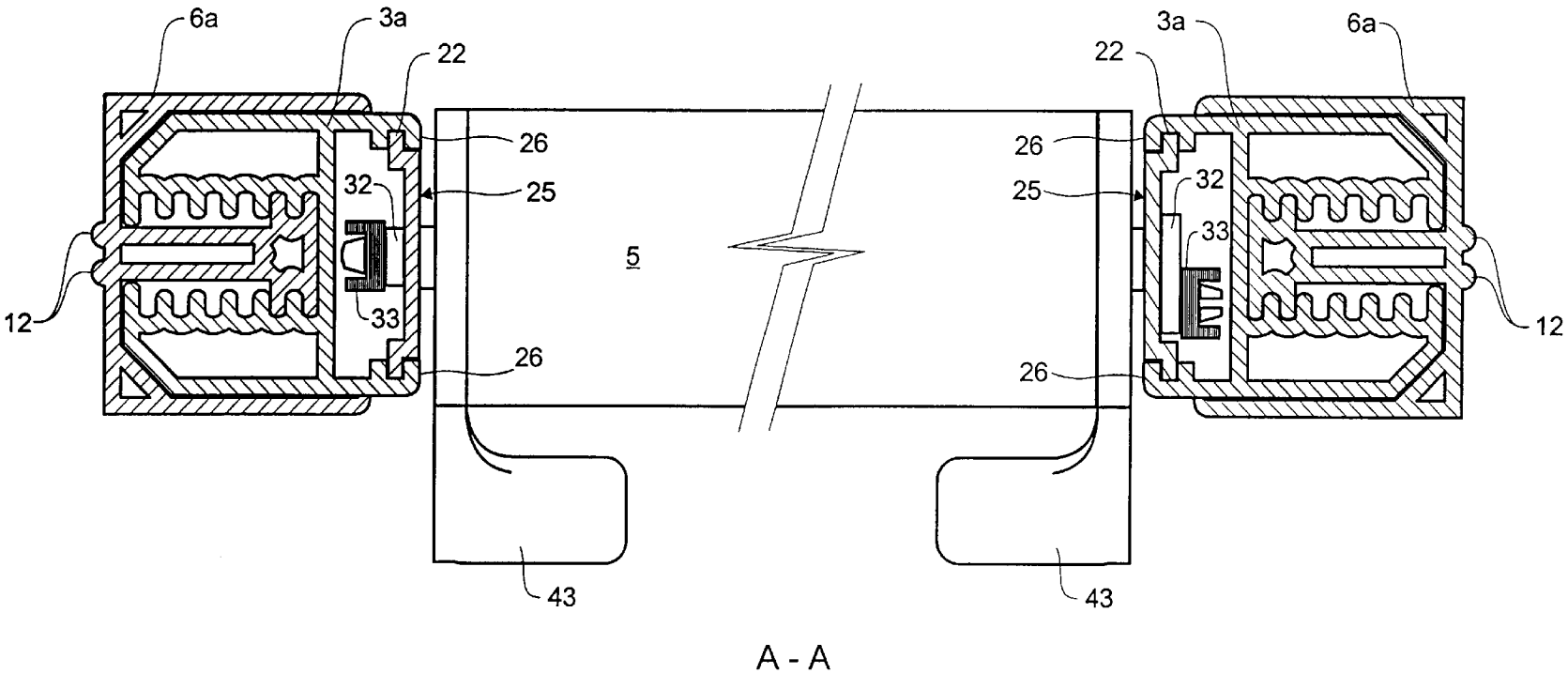
FIG. 3 is a cross-sectional view taken along line A—A of FIG. 1.
Figure 4B:
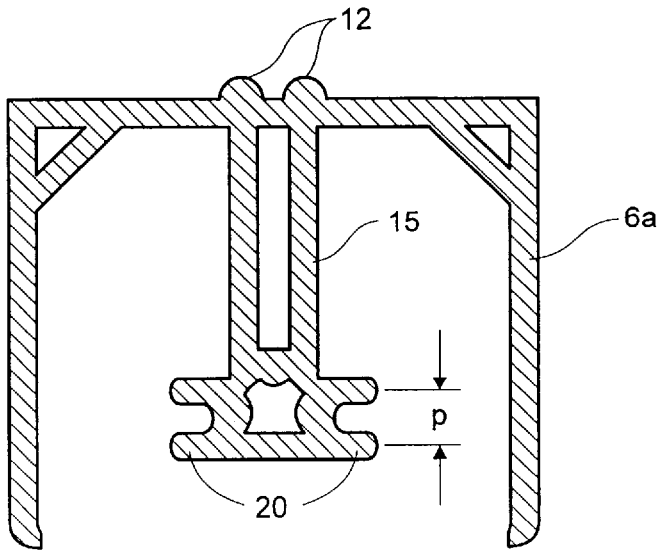
FIGS. 4*a* and 4*b* respectively show the cross sectional shape of a side frame member and a corresponding side frame cover of the embodiment of FIG. 1, and illustrate the components of the adjustment mechanism of the present invention.
Figure 4A:
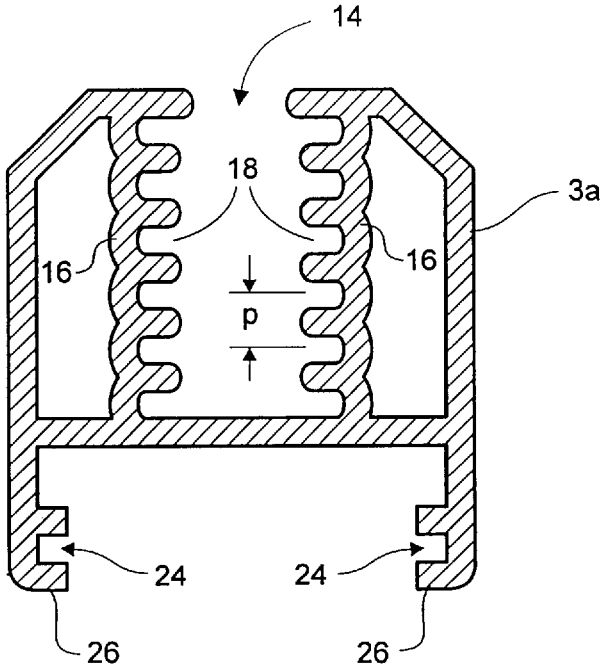
Figure 5C:
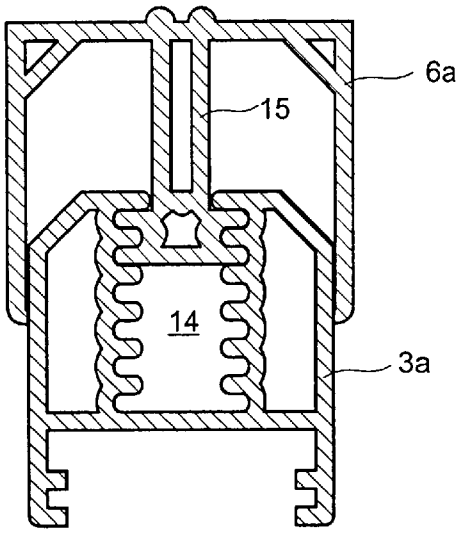
FIGS. 5*a*, 5*b* and 5*c* are cross-sectional views showing a side frame member and side frame cover at respective lower limit, intermediate stage, and upper limit of the range of adjustment of the adjustment mechanism.
Figure 5B:
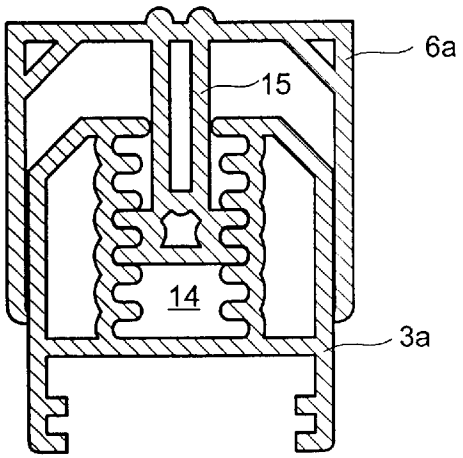
Figure 5A:
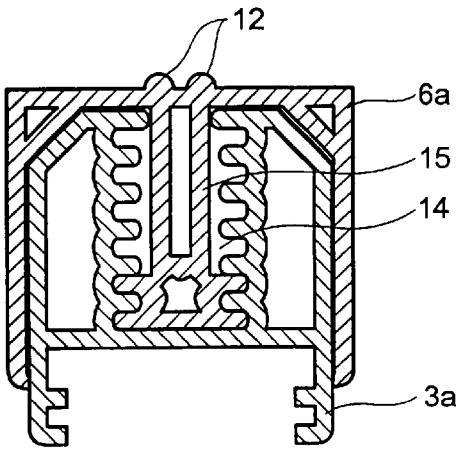

Referring to FIG. 7, each louver rail 22 is provided as an elongate member having a series of bearing holes 27 spaced at regular intervals along the length thereof. Conveiently, a clearance opening 28 can be provided proximal each ends of each louver rail 22 and corresponding to the clearance passage 19 provided in the ends of the side frame members 3*a*. Thus the clearance opening 28 permits passage of the cantilever wall 15 of an adjacent end frame cover 6*b*, and consequently adjustment of the length of the shutter 1 without disassembling the shutter frame 2. Additional semicircular cut-outs 29 can advantageously be provided to permit passage of screws 11 used to secure the side frame members 3*a* to the adjacent end frame members 3*b*. The louver rails 22 can have a regular rectangular cross-section, or can be provided with off-set longitudinal edges, as shown in FIGS. 3 and 7. The use of off-set edges is advantageous in that by this means the exposed face 25 of the louver rail 22 can be arranged to lay flush with the inner edges 26 of the side frame members 3*a* (see FIGS. 3, 4*a*), when the shutter 1 is assembled.

As best seen in FIG. 7, each louver 5 is secured to the louver rails 22 by means of a respective pair of louver end assemblies, each of which comprises a louver end cap 31 which engages an end of the louver 5, and a cam unit 32 which pivotally secures the end cap to the louver rail 22. A respective connector bar 33*a*, 33*b* is pivotally coupled to all of the cam units 32 on each side of the louver frame 21, so that the louvers 5 will be constrained to pivot in unison.

The end cap 31 includes a base plate 34, an extension 35 depending from the base plate for securely coupling the base plate 34 to an end of a respective louver 5; and a receptacle 36. The base plate 34 can be provided with a shape conforming to the cross-section of the louver 5 (as shown in the illustrated embodiment), or can be provided with some other contrasting shape. The shape and configuration of the extension 35 will generally depend on the design of louvers 5. In the illustrated embodiment, the louvers 5 are provided as hollow members, and it is therefore convenient to design the extensions 35 to fit into the interior space of the hollow louver 5 and secure the end cap 31 to the louver 5 by friction.

Referring briefly to FIGS. 10*a* and 10*b*, at least one end cap 31*a* is modified to include a control handle 43 to facilitate user control of the pivot angle of the louvers 5. This modification can conveniently be accomplished by enlarging the base plate 34 to define a lever arm 44 which extends beyond the end of the base plate 34 proper. A handle tab 45 affixed to the lever arm 44 conveniently lays in the plane of a louver 5 attached to the end cap 31*a*.

As shown in FIGS. 9*a* and 9*b*, the cam unit 32 generally comprises a cam body 37, a main shaft 38 extending from one side of the body 37, and a secondary shaft 39 extending from the opposite side of the body 37. The main shaft 38 includes a bearing portion 40 sized to slide within the bearing holes 27 of the louver rail 22, and a bayonet 41 designed to engage the receptacle 36 of the end cap 31 and thereby securely fasten the end cap 31 to the cam unit 32. In the illustrated embodiment, the bearing portion 40 of the main shaft 38 has a circular cross-section to facilitate rotation of the louver end assembly within the bearing hole 27 of the louver rail 22, and the bayonet 41 has a rectangular (preferably square) cross-section so that the end cap 31 (and thus the louver 5) will be locked against rotation with respect to the cam unit 32.

The secondary shaft 39 extends from the opposite side of the cam body 37 and includes a pair of resilient lugs 42 for securely and rotatably fastening the secondary shaft 39 to a respective louver connector bar 33*a*, 33*b*. As may be seen in FIGS. 7 and 9*a* and 9*b*, the axis of the secondary shaft 39 is offset from that of the primary shaft 38, so that a lateral force applied to the secondary shaft 39 (i.e. by the connector bar) will cause rotation of the cam unit 32 about the primary shaft 38, and thus pivot a respective louver 5.

As noted above, and illustrated in the figures, the receptacle 36 of the end cap 31 is designed to receive therein a bayonet 41 of a respective cam unit 32. Preferably, the receptacle 36 will have a shape conforming to the cross-section of the bayonet 41, so that when the bayonet 41 is inserted into the receptacle 36, the end cap 31 will be prevented from rotating relative to the cam unit 32. Still more preferably, the bayonet 41 and receptacle 36 will be square in cross-section, so that the end cap 31 and cam unit 32 can be assembled in any of two orthogonal configurations. As may be seen in FIG. 7, in a first configuration (on the right hand side of FIG. 7), the cam body 37 and base plate 34 of the end cap 31 are arranged substantially in alignment with each other. Conversely, in the second configuration (on the left hand side of FIG. 7), the cam body 37 and the base plate 34 of the end cap 31 are rotated approximately 90° with respect to each other.

In accordance with the present invention, all of the louver end assemblies on one side of the louver frame 21 are assembled in a first configuration; and all of the louver end assemblies on the opposite side of the louver frame 21 are assembled in the second configuration. Respective connector bars 33*a*, 33*b* can then be fastened to the secondary shafts 39 of the cam units 32 on each side of the louver frame 21. As will be seen in FIGS. 3 and 7, when the louvers are angled at approx. 90° to the plane of the shutter 1, then one connector bar 33*a* (at the left side of FIGS. 3 and 7) will be arranged substantially in alignment with the bearing holes 27 of the corresponding louver rail 22, while the other connector bar 33*b* will be at a maximum offset from the bearing holes 27 of its corresponding louver rail 22. The skilled artisan will recognise that in this configuration, if a user grasps a handle 43 and attempts to pivot the louvers by moving the handle, then the first connector bar 33*a* will be loaded in bending, and thus will be largely ineffective for causing the other louvers to move in unison. However, the second connector bar 33*b* will be loaded in substantially pure tension/compression, and thus will be highly effective for causing the other louvers to move in unison. At all intermediate angles (i.e. between 0 and 90°) of the louvers, at least one of the connector bars 33*a*, 33*b* will always be out of alignment with the holes 27 of its corresponding louver rail, and thus will be effective for causing the louvers to move in unison. This arrangement makes unnecessary a separate spacer rod connecting the edges of the louvers, as is commonly used in conventional shutter units. A further advantage of the present invention is that the cam units and connector bars are entirely concealed with the side frame members 3*a* (See FIG. 3), thereby further improving the appearance of the assembled shutter 1.

In use, the shutter can be assembled, and the length and width dimensions adjusted as described above, so that the assembled shutter will provide a "custom fitted" appearance when installed in a window frame. Actual installation of the assembled shutter can be accomplished by methods which are known in the art, for example by the use of conventional hinges secured to a side frame cover 6*a*.

It will be recognized that seen that the above described embodiments of the invention may be varied without departing from the scope of the invention. Thus it will be understood that the above-described and illustrated embodiments of the invention are intended to be illustrative, rather than limitative of the present invention.

What is claimed is:

1. An adjustable shutter comprising:

(a) a substantially rectangular shutter frame comprising first and second pairs of opposed spaced apart frame members (3*a*, 3*b*) and defining a substantially rectangular opening between the frame members;

(b) a plurality of substantially parallel louvers operatively mounted within the shutter opening and extending between the opposed pair of first frame members, the louvers being capable of at least partially occluding the rectangular opening of the shutter frame;

(c) respective first and second frame covers (6*a*, 6*b*) operatively affixed to each one of the frame members;

(d) an adjustment mechanism disposed between at least one frame member and its respective frame cover, the adjustment means being operable to adjust a separation between the frame member and its respective frame cover, whereby a first overall dimension of the shutter is adjustable; and (e) a respective corner cover member disposed in operative relation to each of the first and second frame covers to visually occlude gap between each first frame cover and an adjacent second frame cover.

2. An adjustable shutter as defined in claim 1, wherein the adjustment mechanism comprises:

(a) a pair of opposed walls of the frame member defining an interior longitudinal channel, each of the opposed walls comprising a plurality of parallel opposed longitudinal grooves;

(b) a cantilevered wall disposed longitudinally within the cover member, the cantilevered wall being suitably dimensioned to facilitate sliding engagement within the longitudinal channel of the first frame member, a free longitudinal edge of the cantilevered wall comprising at least one pair of opposed longitudinal ridges capable of sliding engagement with a respective pair of opposed longitudinal grooves.

3. An adjustable shutter as defined in claim 2, wherein the pairs of opposed frame members comprise one pair of opposed elongate first frame members adapted for operatively supporting the purality of louvers, and one pair of opposed elongate second frame members capable of being substantially rigidly affixed to the first frame members for maintaining the first frame members in substantially parallel spaced relation.

4. An adjustable shutter as defined in claim 3, wherein an adjustment mechanism is provided between at least one first frame member and its respective frame cover, whereby an overall lateral dimension of the shutter is adjustable.

5. An adjustable shutter as defined in claim 4, wherein an adjustment mechanism is provided between each first frame member and its respective frame cover, whereby an overall lateral dimension of the shutter is adjustable.

6. An adjustable shutter as defined in claim 3, wherein an adjustment mechanism is provided between at least one second frame member and its respective frame cover, whereby an overall longitudinal dimension of the shutter is adjustable.

7. An adjustable shutter as defined in claim 6, wherein an adjustment mechanism is provided between each second frame member and its respective frame cover, whereby an overall lateral dimension of the shutter is adjustable.

8. An adjustable shutter as defined in claim 3, wherein a respective first adjustment mechanism is provided between at least one first frame member and its respective frame cover, and a respective second adjustment mechanism is provided between at least one second frame member and its respective frame cover, whereby overall lateral and longitudinal dimensions of the shutter is adjustable independently of one another.

9. An adjustable shutter as defined in claim 3, wherein the plurality of louvers are operatively affixed to a pair of opposed louver rails to define a louver frame, the louver frame being secured within the shutter frame by securing each of the louver rails to a respective one of the first frame members.

10. An adjustable shutter as defined in claim 9, wherein each louver rail includes a pair of opposed longitudinal edge portions slidably engagable with a corresponding pair of opposed longitudinal groove portions of a respective first frame member, whereby the louver rail can be secured to the respective first frame member by sliding the louver rail longitudinally of the first frame member to engage the longitudinal edge portions of the louver rail with the longitudinal groove portions of the first frame member.

11. An adjustable shutter as defined in claim 9, wherein the louvers are pivotably mounted on the louver rails.

12. An adjustable shutter as defined in claim 9, wherein the louvers are rigidly mounted on the louver rails.

13. An adjustable shutter as defined in claim 11, wherein each one or the plurality of louvers is secured to the louver rails by means of a respective pair of louver end assemblies, each louver end assembly comprising:

(a) a louver end cap substantially rigidly affixed an end of the louver, and including a shaft portion capable of rotatably engaging a support hole of a respective louver rail; and (b) a cam rigidly mountable on a free end of the shaft portion, the cam being capable of securing the louver end cap within the support hole of the respective louver rail so as to prevent the louver from disengaging from the louver rail.

14. An adjustable shutter as defined in claim 13, further comprising a cam connector capable of operatively engaging a free end of the cam of each louver end assembly pivotably mounted on a respective louver rail, whereby all of the plurality of louvers will pivot in unison.

15. An adjustable shutter as defined in claim 14, wherein the louver end assemblies mounted on one of the louver rails are assembled so that the cams thereof are oriented at a first predetermined angle with respect to the louvers, and the louver end assemblies mounted on the other one of the louver rails are assembled so that the cams thereof are oriented at a second predetermined angle with respect to the louvers, the first and second predetermined angles being separated by approximately 90 degrees.

* * * * *